US005724954A

United States Patent [19]

Smith

[11] Patent Number: 5,724,954

[45] Date of Patent: Mar. 10, 1998

[54] PROJECTILE LAUNCHER AND COCKING MECHANISM FOR SAME

[75] Inventor: Joseph J. Smith, Cincinnati, Ohio

[73] Assignee: Hasbro, Inc., Pawtucket, R.I.

[21] Appl. No.: 788,902

[22] Filed: Jan. 23, 1997

[51] Int. Cl.[6] ..... F41B 11/14; F41B 11/18

[52] U.S. Cl. ..... 124/66

[58] Field of Search ..... 124/37, 66, 67, 124/83

[56] References Cited

U.S. PATENT DOCUMENTS

| | | | |
|---|---|---|---|
| 1,240,991 | 9/1917 | Lefever | 124/66 |
| 1,248,507 | 12/1917 | Lefever | 124/65 |
| 1,633,031 | 6/1927 | Lefever | 124/66 |
| 2,409,653 | 10/1946 | Amdur | 124/63 |
| 2,449,187 | 9/1948 | Walters | 124/65 |
| 2,587,687 | 3/1952 | Beyers | 124/66 |
| 2,831,475 | 4/1958 | Daniel | 124/66 |
| 3,271,033 | 9/1966 | Parker | 124/57 |
| 3,765,396 | 10/1973 | Kienholz et al. | 124/65 |
| 4,289,109 | 9/1981 | D'Andrade | 124/67 |
| 4,630,756 | 12/1986 | Amici et al. | 222/78 |
| 4,666,419 | 5/1987 | Droller et al. | 446/330 |
| 4,689,033 | 8/1987 | Droller et al. | 446/183 |
| 4,870,945 | 10/1989 | Hutchison | 124/68 |
| 5,186,156 | 2/1993 | Clayton | 124/59 |
| 5,205,271 | 4/1993 | Salva | 124/66 |
| 5,242,323 | 9/1993 | Rappaport | 446/180 |
| 5,323,755 | 6/1994 | Hsieh | 124/66 |
| 5,377,655 | 1/1995 | Arad | 124/65 |
| 5,535,729 | 7/1996 | Griffin et al. | 124/66 |

FOREIGN PATENT DOCUMENTS

| | | | |
|---|---|---|---|
| 507487 | 9/1930 | Germany | 124/67 |
| 483899 | 1/1938 | United Kingdom . | |

*Primary Examiner*—John A. Ricci

*Attorney, Agent, or Firm*—Marshall, O'Toole, Gerstein, Murray & Borun

[57] ABSTRACT

There is disclosed a projectile launcher having a housing, a launch tube slidably engaged to the housing, and a spring-loaded piston that is cocked by sliding the launch tube relative to the housing. After cocking, when it is desired to launch a projectile, a trigger is pulled, thereby uncocking the spring-loaded piston and launching the projectile. The projectile launcher may include one or more appendages joined to the housing and the trigger for movement when the trigger is pulled.

25 Claims, 6 Drawing Sheets

PROJECTILE LAUNCHER AND COCKING MECHANISM FOR SAME

FIELD AND BACKGROUND OF THE INVENTION

This invention relates generally to projectile launchers and particularly to a projectile launcher having a launch tube for cocking a spring-loaded piston that is later released to compress fluid such as air in a portion of the launch tube to fire a projectile from another portion of the launch tube. The launcher can also have one or more appendages that move when a trigger is pulled to release the spring-loaded piston.

Typical projectile launchers have a firing mechanism including a spring-loaded piston to compress gas and launch a projectile. In some launchers, a user cocks the piston by pulling a grip attached to the piston until the piston is releasably locked in a cocked position by a mechanism such as a spring-loaded sear. When the piston is released from the cocked position, such as when the user pulls a trigger, the spring urges the piston toward an uncocked position to compress air in a cylinder and launch a projectile from a launch tube. Other types of mechanisms have been used to cock a spring-loaded piston, including pivoting handles and sliding handles. In such conventional projectile launchers, however, it is the grip or some separate mechanism, rather than the launch tube, which cocks the piston.

Devices having moving appendages are disclosed in U.S. Pat. Nos. 4,666,419 and 4,689,033. The '419 patent discloses a device having manually movable leg members. The '033 patent discloses an integrally formed leg member having six movable legs. Neither of these patents, however, discloses a trigger for moving an appendage simultaneously with the launching of a projectile from a launch tube cocking mechanism.

Thus, it is desirable to have a projectile launcher with a launch tube for cocking a spring-loaded piston and for launching a projectile. It is also desirable to have a projectile launcher having a trigger for launching a projectile while moving one or more appendages.

SUMMARY OF THE INVENTION

A projectile launcher in accordance with the present invention includes a launch tube for cocking a spring-loaded piston. The mechanism for launching a projectile may include a mechanism for moving an appendage pivotally mounted on the launcher housing.

One embodiment of a projectile launcher in accordance with the present invention includes: a housing; a projectile launch tube slidably joined to the housing for movement between a first position and a second position, wherein the launch tube includes a first portion for releasably mounting a projectile and a hollow second portion in fluid communication with the first portion; a launch tube spring biasing the launch tube toward the first position; a piston slidably disposed in the housing for movement from an uncocked position to a cocked position in response to the launch tube moving from the first position to the second position, and from the cocked position to the uncocked position to compress fluid in the second portion of the launch tube; a piston spring biasing the piston toward the uncocked position; a sear slidably joined to the housing for releasably retaining the piston in the cocked position; and release means for sliding the sear to release the piston from the cocked position.

The launch tube may further comprise a divider disposed between the first portion and the hollow second portion, the divider defining an aperture in fluid communication with the first and second portions of the launch tube and through which compressed fluid such as air may flow. The divider may engage and cock the piston as the launch tube is moved from the first position to the second position. The divider may further comprise a conduit in fluid communication with the hollow second portion and disposed in the first portion of the launch tube. The hollow second portion of the launch tube may be adapted to slidably receive the piston.

The projectile launcher may further include a sear spring for biasing the sear toward a first position and a cam pivotally connected to the release means for movement from a first position to a second position to slide the sear toward a second position and release the piston from the cocked position.

The release means may comprise an appendage pivotally engaged to the housing. The release means may comprise a trigger pivotally joined to the housing. The trigger may include a slot, and the cam may include a pin slidably disposed in the trigger slot to translate pivoting movement of the trigger to linear movement of the cam.

The projectile launcher may include one or more appendages pivotally joined to the housing, and a linkage joined to the trigger and to the one or more appendages for pivoting the appendages between a first position and a second position when the trigger pivots. The linkage may include a frame defining a camming slot corresponding to an appendage, and the appendage may include a pin slidably disposed in the camming slot to translate linear movement of the linkage to pivoting movement of the appendage. A spring may be connected to the trigger for biasing the trigger and the appendages toward their respective first positions.

Another projectile launcher in accordance with the present invention includes: a housing; a projectile launch tube slidably joined to the housing for movement between a first position and a second position, the launch tube including a first portion for removably mounting a projectile and a hollow second portion in fluid communication with the first portion; a launch tube spring biasing the launch tube toward the first position; a piston slidably disposed in the housing for movement from an uncocked position to a cocked position in response to the launch tube moving from the first position to the second position, and from the cocked position to the uncocked position to compress fluid in the second portion of the launch tube; a piston spring biasing the piston toward the uncocked position; a sear slidably joined to the housing for releasably retaining the piston in the cocked position; an appendage pivotally engaged to the housing; and a trigger pivotally joined to the housing for sliding the sear to release the piston from the cocked position and for pivoting the appendage.

This embodiment of the projectile launcher may also include a divider disposed between the first portion of the launch tube and the hollow second portion of the launch tube, the divider defining an aperture in fluid communication with the first and second portions of the launch tube and through which compressed fluid may flow. The divider may further comprise a conduit in fluid communication with the second portion and disposed in the first portion of the launch tube. The hollow second portion of the launch tube may be adapted to slidably receive the piston.

The projectile launcher may further include a sear spring for biasing the sear toward a first position and a cam pivotally connected to the trigger for movement from a first position to a second position to slide the sear toward a second position and release the piston from the cocked position. The trigger may include a slot, and the cam may include a pin slidably disposed in the trigger slot to translate pivoting movement of the trigger into linear movement of the cam. The appendage may comprise means for sliding the sear to release the piston from the cocked position when the appendage moves from a first position to a second position.

DETAILED DESCRIPTION OF THE DRAWINGS

Figure 1:
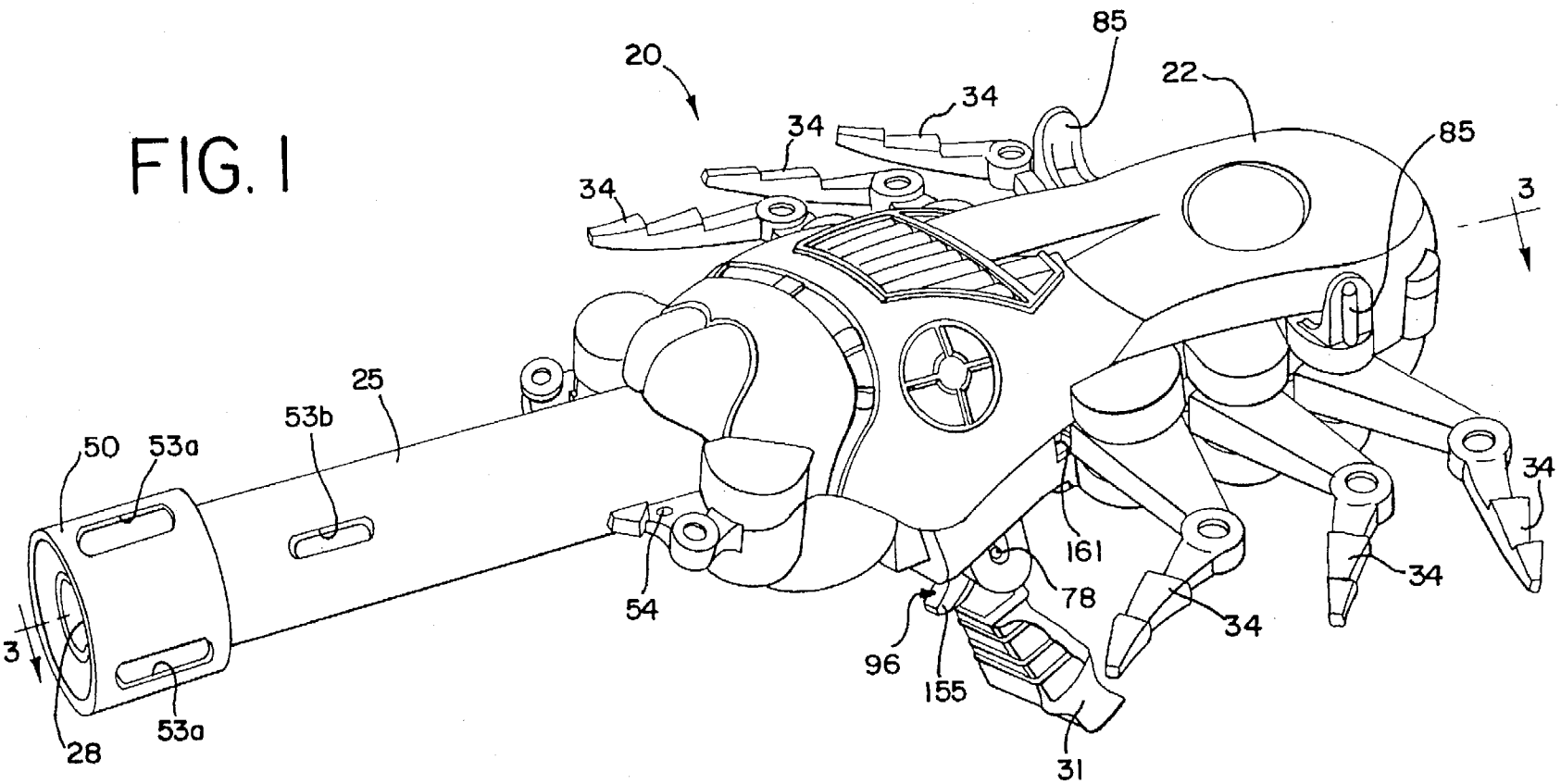
FIG. 1 is a perspective view of a projectile launcher in accordance with the present invention.

To the extent practical, the same reference numerals will be used with the same element in each of the figures. Illustrated in FIG. 1 is a projectile launcher 20 in accordance with the present invention which includes a housing 22, a launch tube 25, a handle 31, and a plurality of pivoting appendages 34. A projectile 28, such as a plastic-tipped foam dart, is positioned in the launch tube 25.

The housing 22 is a hollow shell, preferably manufactured of plastic in upper and lower halves that can be secured together by any suitable means such as threaded fasteners or sonic welding. The housing 22 is preferably shaped in the form of a stylized insect, as illustrated, or an arachnid, but the housing 22 can be of any shape or style as play criteria require.

Figure 2:
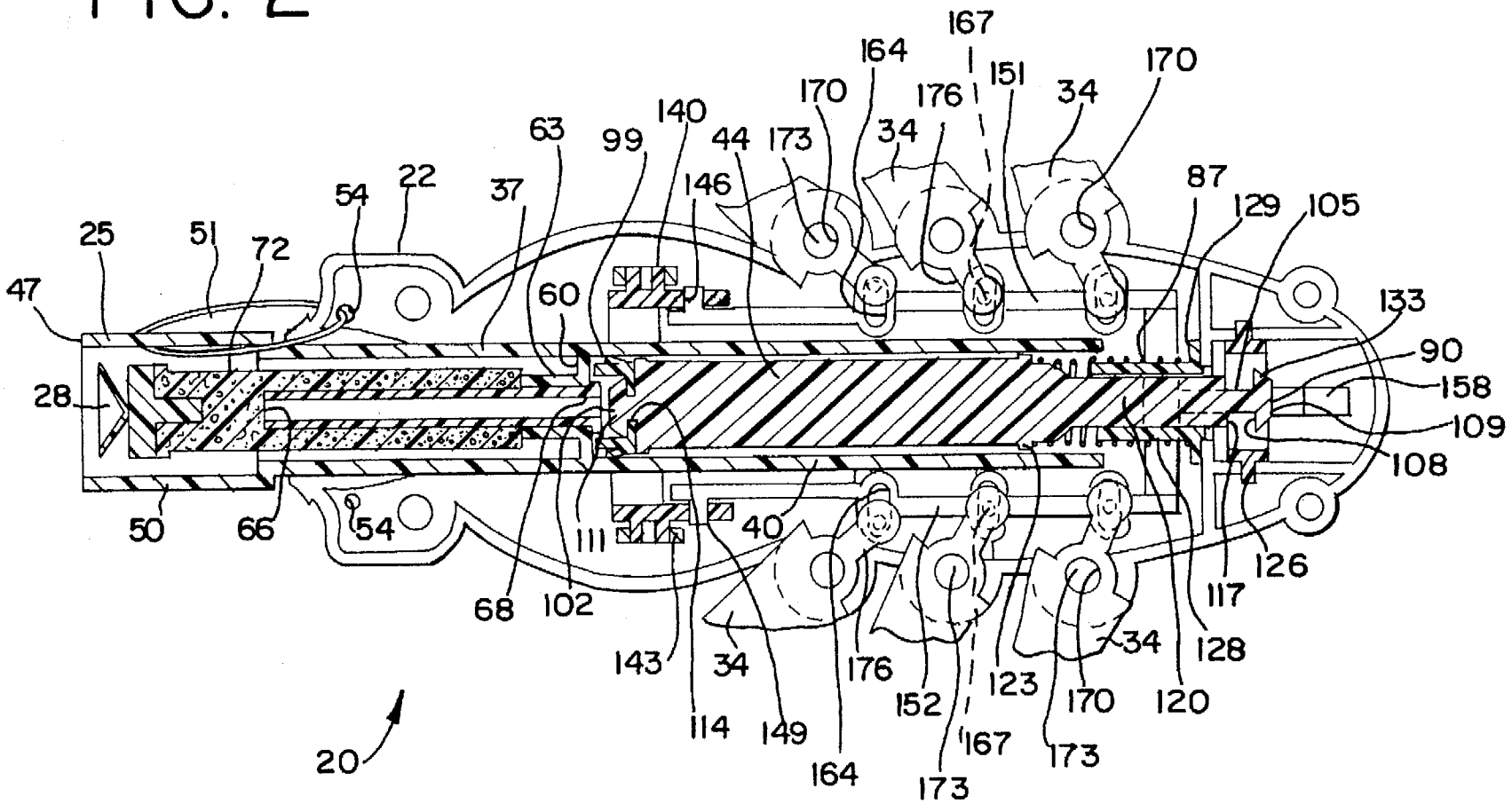
FIG. 2 is a cross-sectional plan view of the projectile launcher with a launch tube cocking a spring-loaded piston.

Referring to FIG. 2, the launch tube 25 has a first portion 37 for receiving the projectile 28 and a hollow second portion 40 for slidably receiving a piston 44. The first portion 37 has a first end 47 distal to the housing 22 and may be sized to receive the projectile 28 in a snug fit, however, the launch tube 25 can be of any suitable size to accommodate projectiles of different sizes and shapes.

The launch tube 25 is slidably engaged to the housing 22 to allow the launch tube 25 to cock the launch mechanism, as described in detail below. A first launch tube 25 position is seen in FIGS. 1 and 3–6 in which the first end 47 of the first portion 37 is maximally extended away from the housing 22. A second position or cocking position, shown in FIG. 2, is the position of the launch tube 25 during maximum insertion into the housing 22, which occurs during cocking.

The first portion 37 of the launch tube 25 preferably has a collar 50 to prevent jamming the launch tube 25 too far into the housing 22 while cocking and also to protect the projectile 28 from being impacted by a user's hands during cocking. Apertures **53*a* (FIGS. 1, 8) may be placed in the collar 50 to provide users a side view of the projectile 28 while the projectile 28 is in the launch tube 25. For safety, apertures 53*b* (FIG. 1) may be placed in other areas of the first portion 37 of the launch tube 25 to prevent users from improvising unsafe projectiles, as discussed in greater detail below in connection with the operation of the projectile launcher 20**.

The launch tube 25 is generally cylindrical and the collar 50 is coaxial with and wider than the remainder of the first portion 37 to facilitate insertion of the projectile 28. The projectile launcher 20 may be stored in a relatively compact configuration by tying a string 51 (FIG. 2), a wire (not shown), or a similar fastener through one of the apertures **53*a* and through an aperture 54 (FIGS. 1–3, 5) located in the front of the housing 22 so that the launch tube 25** is restrained in the second or cocking position.

Figure 8:
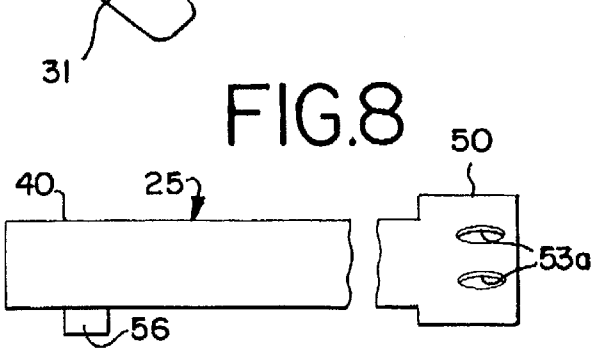
FIG. 8 is a side elevational view of a launch tube in accordance with the present invention.

As seen in FIG. 8, the second portion 40 of the launch tube 25 has a retaining tab 56 that is preferably molded integrally with the launch tube 25. The retaining tab 56 prevents the launch tube 25 from being pulled from the housing 22 by engaging the launch tube 25 to a retaining wall (not shown) in the housing 22 during maximum extension of the launch tube 25.

Figure 3:
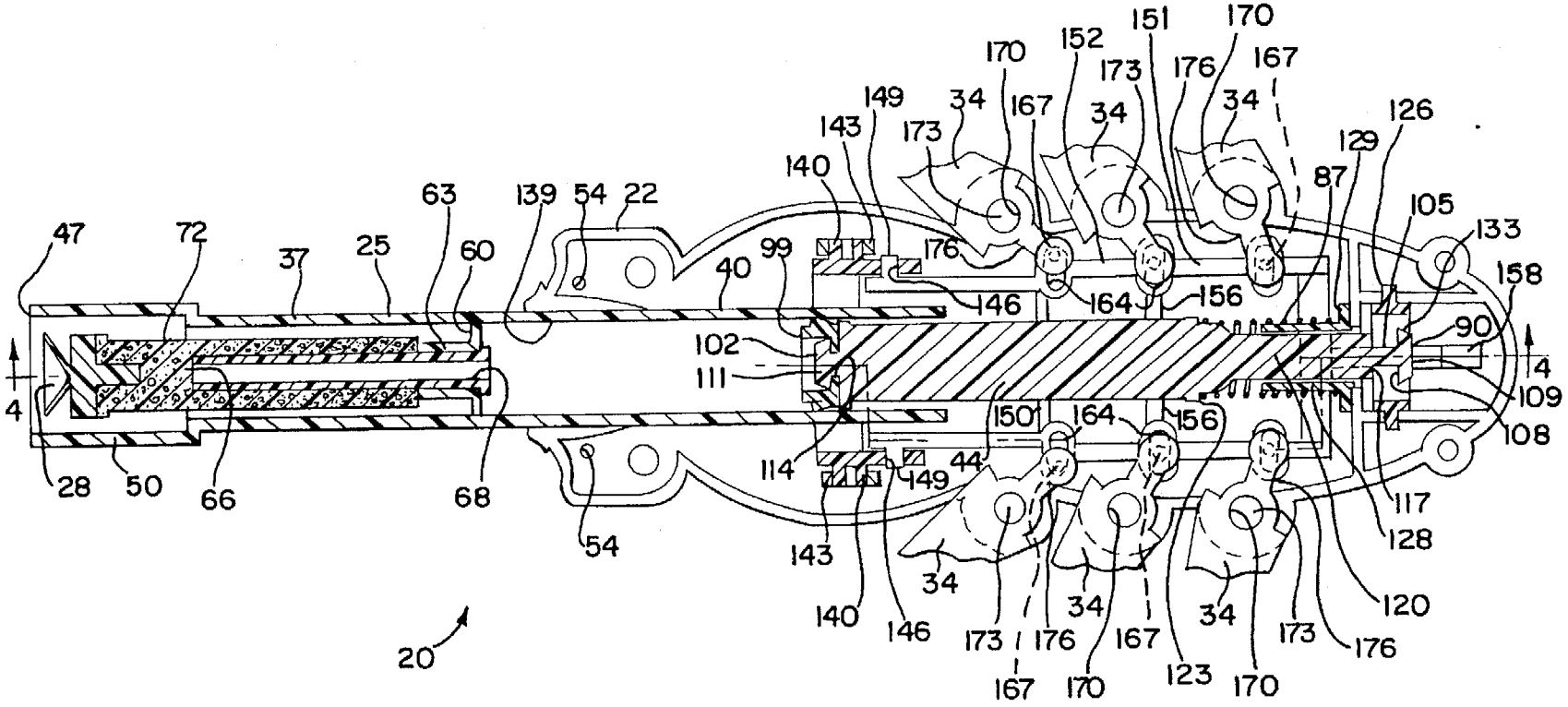
FIG. 3 is a cross-sectional plan view of the projectile launcher taken along line 3—3 in FIG. 1.
Figure 4:
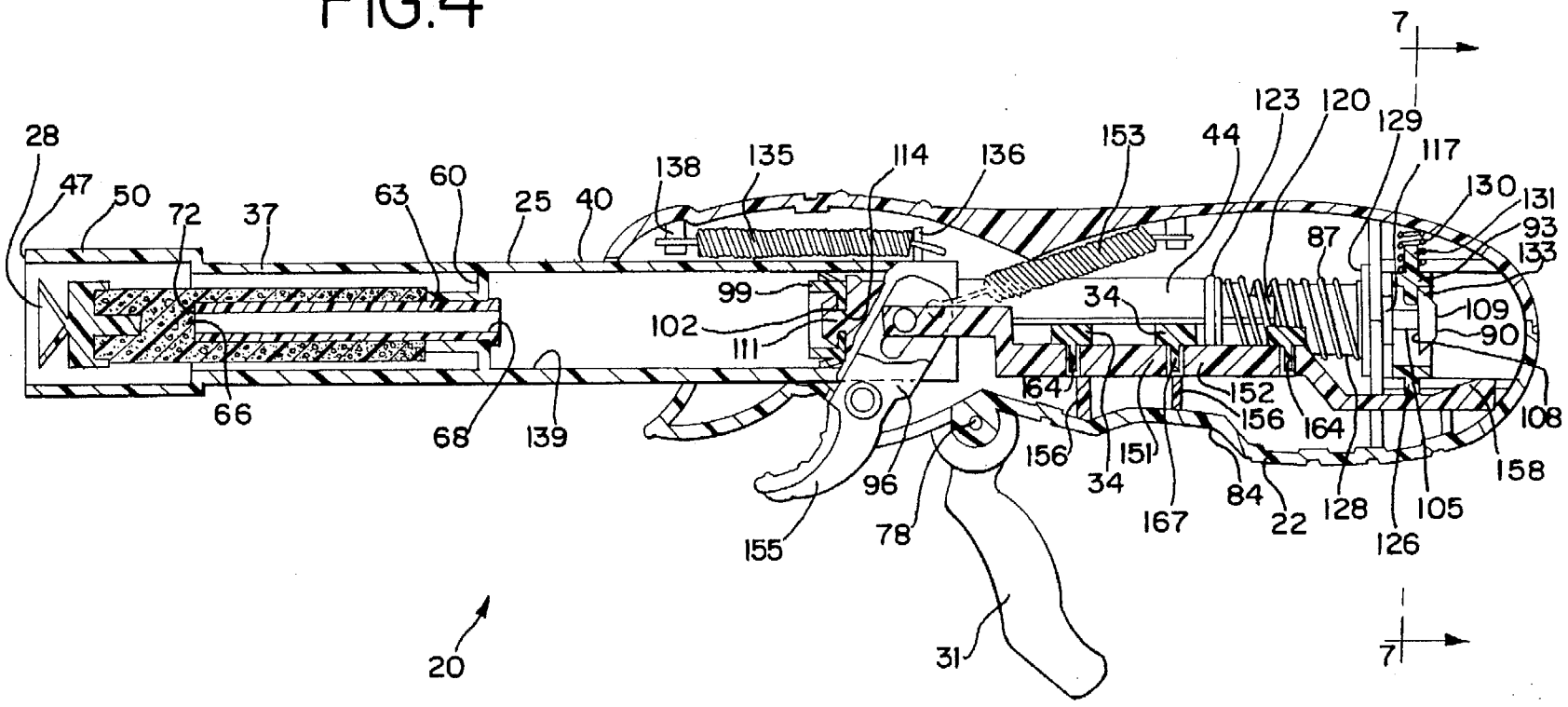
FIG. 4 is a cross-sectional view of the projectile launcher in the cocked position taken along line 4—4 in FIG. 3.

A divider 60 is located between the first and second launch tube portions 37, 40. A conduit 63 extends from the divider 60 into the first portion 37 of the tube 25, permitting fluid communication between the first and second portions 37, 40. When mounted in the first portion 37, the projectile 28 may accommodate the conduit 63 in a cylindrical opening 66 defined by the projectile 28, as seen in FIGS. 2–4. Preferably, there is a snug fit between the projectile 28 and the outer surface of the conduit 63 to prevent the projectile 28 from inadvertently falling out of the launch tube 25. Other shapes and sizes of launch tubes and projectiles may be used. For example, a safety guard (not shown) may extend across the forward end of the conduit 63, permitting fluid to exit the conduit 63 but preventing users from inserting unsafe improvised projectiles into the conduit 63. The periphery of the conduit 63 may include ribs (not shown) to prevent improvised projectiles from forming a seal around the conduit 63.

Also alternatively, the conduit 63 may be omitted, in which case an aperture 68 in the divider 60 permits fluid communication between the first and second tube portions 37, 40. If the projectile 28 is not to be mounted around the conduit 63, either because the projectile 28 is solid or because the conduit 63 has been omitted, a snug fit between the projectile 28 and the interior surface of the first tube portion 37 is preferred for best flight characteristics.

Figure 6:
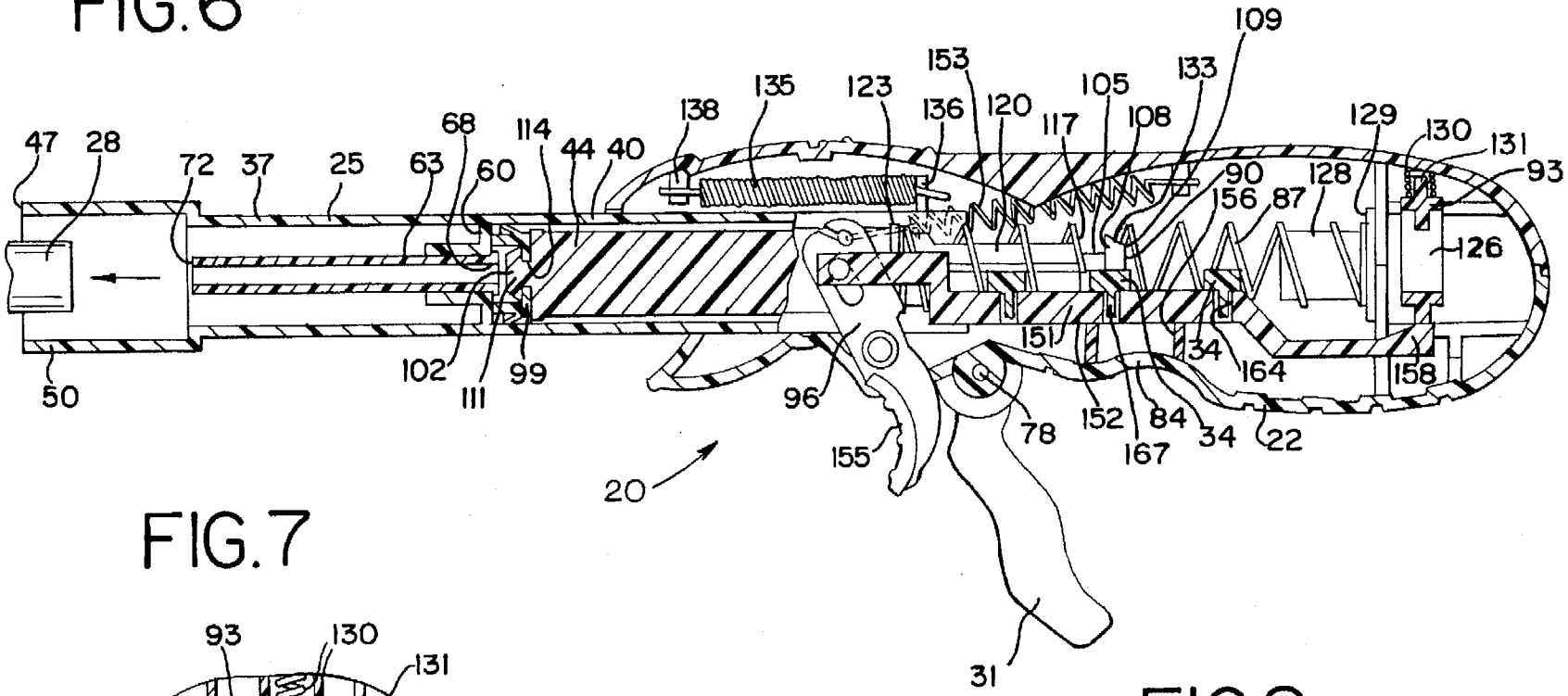
FIG. 6 is a cross-sectional side view of the projectile launcher in the uncocked position taken along line 6—6 in FIG. 5.

Referring to FIGS. 1, 4, and 6, the handle 31 is preferably located on the bottom of the housing 22 to facilitate grasping by a user's hands. The size of the handle 31 should enable a user's hands to steadily grip the projectile launcher 20 during use. As illustrated, the handle 31 may be pivotally attached to the housing 22 by a hinge 78 or other suitable means. A protrusion (not shown) preferably extends from the handle 31 and releasably locks the handle 31 in an open position by engaging a mating resilient detent in the housing 22. In this fashion, the handle 31 may be conveniently stowed adjacent the housing 22 when not in use. A recess 84 (FIGS. 4 and 6) in the housing 22 may receive at least a portion of the handle 31 when the handle 31 is stowed.

Other features can be mounted on the housing 22. For example, the housing 22 may comprise projectile clips 85 (FIG. 1) for storing spare projectiles 28 or may comprise an extra handle (not shown).

As best seen in FIGS. 2–6, the piston 44 is disposed inside the housing 22 and includes a rear section 90, a piston seal 99 at its fore end 102, a notch 105 toward the rear section 90, and a rear end 109.

The piston seal 99 has a diameter slightly larger than the inside diameter of the hollow second portion 40 of the launch tube 25 to compress the seal 99 slightly and provide good sealing contact between the seal 99 and the inside of the second portion 40 of the launch tube 25. The seal 99 is joined to the fore end 102 of the piston 44 by pushing a pin 111 with an oversized head through a small hole 114 in the seal 99. The seal 99 may be joined to the piston 44 by any other suitable means.

The piston notch 105 has a vertical rear portion 108 and a vertical fore portion 117. A beveled rear section 133 of the piston 44 extending from the vertical rear portion 108 to the piston rear end 109 is tapered so that the piston 44 can slide a spring-loaded sear 93 up and over the piston end 109 so that the notch 105 can be engaged by the spring-loaded sear 93 that holds the piston 44 in a cocked position. The seal 99 is preferably located in the second portion 40 at all times, including, as seen in FIGS. 3 and 4, when the launch tube 25 is in the first position or fully extended position and the piston 44 is cocked. Piston 44 alignment is maintained by an annular guide 128 (FIGS. 2–6) fixed to or integral with the interior of the housing 22.

A piston spring 87 is mounted around a narrow rear portion 120 of the piston 44 and urges the piston 44 in a forward direction toward an uncocked position. The narrow rear portion 120 includes the piston notch 105 and extends forward of the notch 105 to a flange 123. The flange 123 prevents the spring 87 from passing over the entire piston 44 because the flange 123 is wider than the spring 87 inner diameter.

Figure 7:
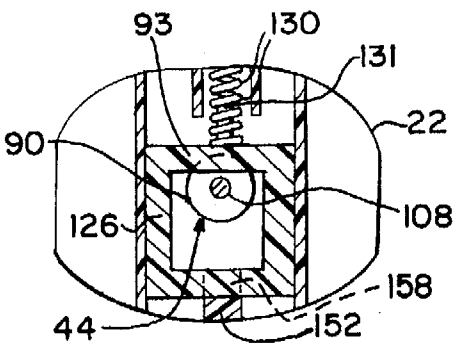
FIG. 7 is a cross-sectional side view of the projectile launcher taken along the line 7—7 in FIG. 4.

In FIGS. 4, 6, and 7 it can be seen that the sear 93 has a frame 126 and that a sear coil spring 130 is used to bias the sear 93 toward the piston 44. The spring 130 is mounted around a pin 131 extending upward from the sear 93. The frame 126 may be square, as shown in FIG. 7, or any other shape which will not interfere with the rear end 109 of the piston 44 when the piston 44 is cocked. The annular guide 128 (FIGS. 2–6) guides the rear end 109 of the piston 44 through the frame 126. A flange 129 on the guide 128 abuts the rear end of the spring 87, preventing longitudinal movement of the rear end of the spring 87 with respect to the housing 22.

A trigger 96 has shoulders 140 pivotally engaged between bottom supports 143 (FIGS. 2, 3, and 5) extending from the bottom half of the housing 22 and top supports (not shown) extending from the top half of the housing 22. The supports 143 and the top supports are preferably integral with their respective halves of the housing 22 but may instead be fixed to their respective halves of the housing 22. The trigger 96 has one or more transverse slots 146 for pivotally receiving one or more corresponding pins 149 from a linkage 151 comprising a frame 152 disposed in the housing 22. The slots 146 are oblong to accommodate the pins 149 when the pins 149 move in a direction perpendicular to the longitudinal axis of the launch tube 25. Alternatively, the trigger 96 may have pins (not shown) instead of the trigger slots 146 and the linkage 151 may have slots (not shown) in place of the linkage pins 149 for pivotally receiving the trigger pins.

A spring 153 (FIGS. 4 and 6) connects the trigger 96 to the housing 22. The spring 153 urges a trigger section 155 (FIGS. 1, 4, and 6) extending outside of the housing 22 toward a first or forward position. The trigger slots 146 and the trigger section 155 are located on opposite sides of the shoulders 140. With this arrangement, rearward pivoting movement of the trigger section 155, such as when the trigger section 155 is pulled by a user, causes forward linear movement of the frame 152 and slots 146. Conversely, forward pivoting movement of the trigger section 155 causes rearward linear movement of the frame 152 and slots 146.

One or more bottom support walls 156 (FIGS. 2–6) fixed to or integral with the interior of the bottom half of the housing 22 and one or more top support walls (not shown) fixed to or integral with the interior of the top half of the housing 22 constrain the frame 152 to movement in a horizontal plane with respect to the housing 22. The bottom support wall or walls 156 and the top support wall or walls may be oriented in any of a number of directions including parallel to the longitudinal axis of the launch tube 25 or perpendicular to the longitudinal axis of the launch tube 25. The bottom support wall or walls 156 need not be parallel to the top support wall or walls.

The frame 152 is preferably composed of a low friction material, such as acetal resin, to reduce friction when the frame 152 slides relative to the housing 22. Suitable acetal resin is produced by the Celanese Corporation under the tradename Celcon, and by DuPont under the tradename Delrin. The housing 22 may be composed of a plastic, such as acrylonitrile-butadiene-styrene resin, or other material.

As illustrated in FIG. 2, the piston 44 is cocked by pushing the launch tube 25 into the housing 22. The launch tube divider 60 engages the fore end 102 of the piston 44, thereby moving the piston 44 back against the force of the piston spring 87. During cocking, the spring 87 is forced against the flange 129 and the rear end 109 of the piston 44 passes through the annular guide 128. When the piston 44 is pushed backward relative to the housing 22 during cocking, the sear 93 rises as the beveled piston rear section 133 slidably engages the sear 93. Due to the sear coil spring 130, the sear 93 engages the piston notch 105 when the beveled piston rear section 133 has passed rearward of the sear 93. The piston 44 is biased forward by the piston spring 87 so the engagement between the piston notch 105 and the sear 93 remains firm.

Although the divider 60 is shown to engage the piston 44 in FIG. 2, a different portion of the launch tube 25 may instead engage the piston 44 for cocking the piston 44. For example, a tab (not shown) may extend from the interior surface of the hollow second portion 40 of the launch tube 25 and engage the piston 44 during cocking.

After cocking, the launch tube 25 returns to its first or fully extended position by the urging of a spring 135 (FIGS. 4 and 6). Although the launch tube 25 shown in FIG. 2 is restrained in the cocking position by the string 51, in embodiments having the string 51, the string 51 is removed by a user prior to operating the projectile launcher 20. The spring 135 is connected to a launch tube pin 136 (FIGS. 4 and 6) on the rear of the launch tube 25 and a pin 138 (FIGS. 4 and 6) extending from the housing 22 at a location forward of the launch tube pin 136. The spring 135 is in tension during cocking. As the launch tube 25 returns to its first position after cocking, the divider 60 moves away from the piston seal 99, forming an air cylinder 139 (FIGS. 3 and 4) within the hollow second portion 40 of the launch tube 25.

To release the piston 44 and compress air in the air cylinder 139 of the second portion 40 of the launch tube 25, the trigger section 155 is pulled rearwardly (FIGS. 5 and 6) causing the slots 146 to pivot forward and pull the frame 152 forward with respect to the housing 22. A ramped portion or cam 158 (FIGS. 4, 6, and 7) at the rear end of the frame 152 also moves forward and urges the sear frame 126 upwardly which urges the sear 93 upwardly. The linkage 151 connects the trigger 96 and the cam 158 and the linkage 151 may be any shape or configuration. The piston 44 is released when the sear 93 has been raised by the cam 158 above the vertical rear portion 108 of the piston notch 105. At that point, urged by the piston spring 87, the piston 44 moves forward quickly to compress air in the air cylinder 139 of the hollow second portion 40 of the launch tube 25 and to force the compressed air through the divider conduit 63. The projectile 28 mounted on the conduit 63 is then forced out of the launch tube 25.

Figure 5:
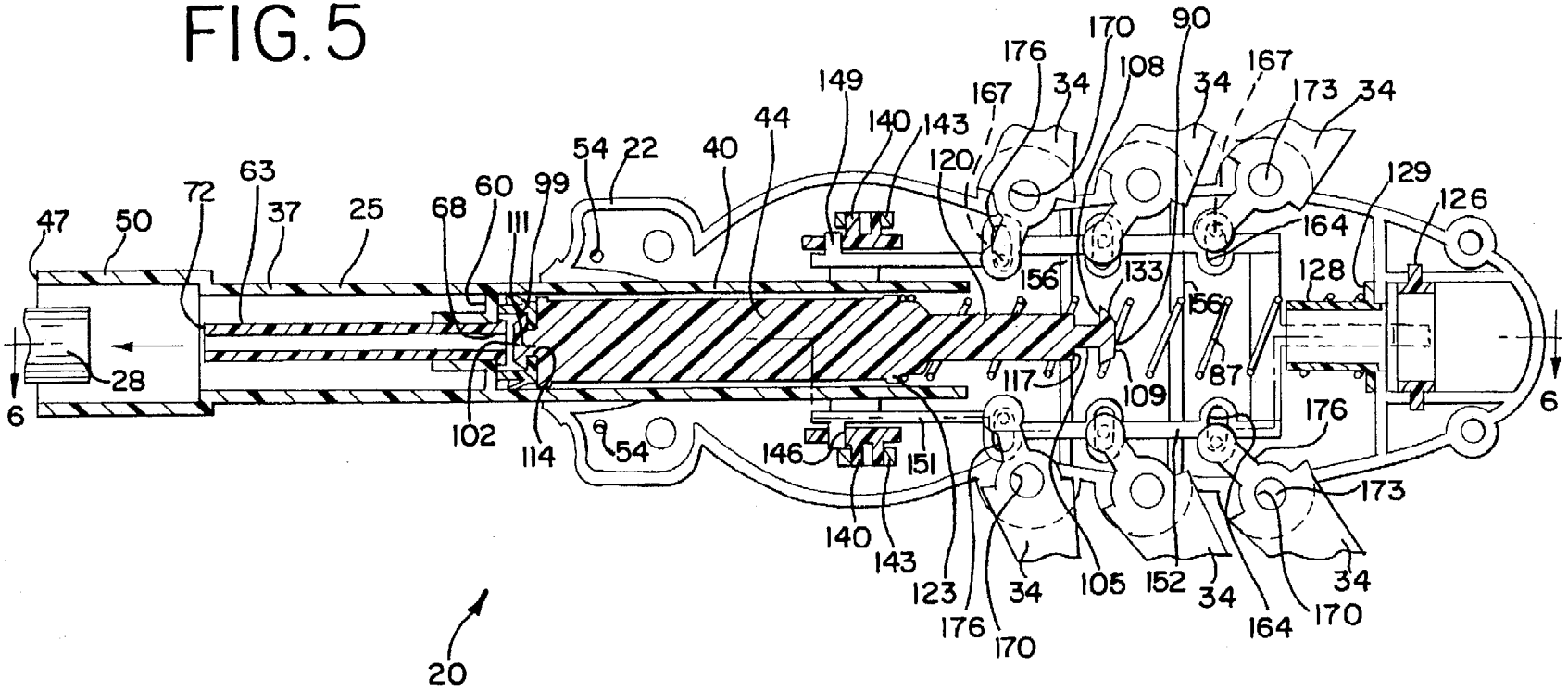
FIG. 5 is a cross-sectional plan view of the projectile launcher in an uncocked position.

As seen in FIGS. 5 and 6, the divider 60 acts as a stop for the piston seal 99 after the piston 44 has advanced through the air cylinder 139. When the piston 44 is in the position shown in FIGS. 5 and 6, the piston 44 is ready to be cocked again by a user pushing the launch tube 25 inwardly with respect to the housing 22.

The fit between the projectile 28 and the launch tube 25 is such that the air launches the projectile 28 out of the tube 25. Particularly, a snug fit between the projectile 28 and the outer surface of the conduit 63 will increase the amount of air pressure that develops between the projectile 28 and the conduit 63 after the trigger 96 has been pulled but prior to projectile ejection (i.e., while the piston 44 compresses air in the air cylinder 139). The increased air pressure results in the projectile 28 being ejected from the launch tube 25 at relatively high speeds.

In an alternative embodiment the conduit 63 is omitted and the projectile 28 is shaped to form a snug fit between the projectile 28 and the interior surface of the first tube portion 37 to develop adequate air pressure while the piston 44 compresses air in the air cylinder 139. But, when the conduit 63 is used, it is preferred to include the apertures **53*b* as a safety feature to prevent users from improvising unsafe projectiles. For example, a user may attempt to launch an improvised projectile that does not form a seal with the conduit 63 but that does form a seal with the inner surface of the first portion 37 of the launch tube 25. In such an event, the apertures 53*b* will release air from the first portion 37 of the launch tube 25 while the piston 44 compresses air in the air cylinder 139. The release of air from the first portion 37 of the launch tube 25** prevents pressure from developing therein, and thereby prevents launching of the improvised projectile.

In the illustrated embodiment, the appendages 34 extend through apertures 161 (FIG. 1) in the housing 22. The appendages 34 may be composed of a plastic, such as low-density polyethylene, or any other suitable material. The frame 152 has a plurality of camming slots 164 that each slidably receive a pin 167 extending from one of the appendages 34. Each appendage 34 has a hole 170 for receiving a corresponding pivot point 173 extending from the housing 22. The camming slots 164 are oblong in a direction transverse to the direction of frame 152 linear movement to accommodate movement of the pins 167 transverse to the direction of frame 152 linear movement when the appendages 34 move between a first position and a second position. The number of appendages 34 may vary (six appendages 34 are shown in FIGS. 1–3, and 5), but any number can be used. Similarly, the number of camming slots 164 in the frame 152 for receiving the pins 167 from the appendages 34 may vary to match the number of the pins 167.

When the trigger 96 pivots, the resulting linear movement of the frame 152 with respect to the housing 22 causes pivoting movement of the appendages 34 around the corresponding pivot points 173. The appendages 34 are in the first position (shown in FIGS. 1–3) when the trigger 96 is forward and the appendages 34 move to the second position (shown in FIG. 5) when the trigger 96 is pulled back. The spring 153 (FIGS. 4 and 6) biases the trigger 96 toward the first position, thereby returning the trigger 96 to the first position after a user has pulled and released the trigger 96.

The appendages 34 may be used instead of the trigger 96 to release the piston 44 and launch the projectile 28. To launch the projectile 28 in this manner, a user first cocks the piston 44, as previously described, and then manually moves one or more of the appendages 34 from the first position to the second position. As the appendages 34 move, the frame 152 is pulled forward with respect to the housing 22 just as though the trigger 96 had been pulled. The cam 158 at the rear end of the frame 152 also moves forward and urges the sear frame 126 upwardly which urges the sear 93 upwardly. The piston 44 is released when the sear 93 has been raised by the cam 158 above the vertical rear portion 108 of the piston notch 105.

The locations of the first and second positions of the appendages 34 relative to the housing 22 are determined, in part, by the distance of the hole 170 in each appendage 34 from the pin 167 of the same appendage 34, because that distance defines a pivot arm 176 for the movement of the appendages 34 when the frame 152 moves the appendage pins 167. The shorter the pivot arm 176, the more angular rotation an appendage 34 undergoes for a particular amount of frame 152 longitudinal linear translation with respect to the housing 22. Thus, if play criteria require a dramatic appendage 34 movement from the first to the second position during each pull of the trigger 96, a short pivot arm 176 would be preferred. Conversely, a relatively long pivot arm 176 is preferable if, during each pull of the trigger 96, only a slight appendage 34 movement from the first to the second position is desired.

The above detailed description is provided for clearness of understanding only and no unnecessary limitations therefrom should be read into the following claims.

I claim:

1. A projectile launcher comprising:

a housing;

a projectile launch tube slidably joined to the housing for movement between a first position and a second position, wherein the launch tube includes a first portion for releasably mounting a projectile and a hollow second portion in fluid communication with the first portion;

a launch tube spring biasing the launch tube toward the first position;

a piston slidably disposed in the housing for movement from an uncocked position to a cocked position in response to the launch tube moving from the first position to the second position, and from the cocked position to the uncocked position to compress fluid in the second portion of the launch tube;

a piston spring biasing the piston toward the uncocked position;

a sear slidably joined to the housing for releasably retaining the piston in the cocked position; and release means for sliding the sear to release the piston from the cocked position.

2. The projectile launcher of claim 1, wherein the launch tube further comprises a divider disposed between the first portion and the hollow second portion, the divider defining an aperture in fluid communication with the first and second portions of the launch tube.

3. The projectile launcher of claim 2, wherein the divider engages the piston as the launch tube is moved from the first position to the second position for cocking the piston.

4. The projectile launcher of claim 2, wherein the divider further comprises a conduit in fluid communication with the divider aperture and disposed in the first portion of the launch tube.

5. The projectile launcher of claim 2, wherein the hollow second portion of the launch tube is adapted to slidably receive the piston.

6. The projectile launcher of claim 1, wherein the release means comprises an appendage pivotally engaged to the housing.

7. The projectile launcher of claim 1, and further comprising:

a sear spring for biasing the sear toward a first position; and a cam pivotally connected to the release means for movement from a first position to a second position to slide the sear toward a second position and release the piston from the cocked position.

8. The projectile launcher of claim 1, wherein the release means comprises a trigger pivotally joined to the housing.

9. The projectile launcher of claim 8, wherein the trigger includes a slot, and wherein the slot slidably receives a pin from a cam to translate pivoting movement of the trigger to linear movement of the cam.

10. The projectile launcher of claim 8, and further comprising:

a plurality of appendages pivotally engaged to the housing; and a linkage joined to the trigger and to the appendages for pivoting the appendages between a first position and a second position when the trigger pivots between a first position and a second position.

11. The projectile launcher of claim 8, and further comprising:

an appendage pivotally engaged to the housing; and a linkage joined to the trigger and to the appendage for pivoting the appendage between a first position and a second position when the trigger pivots between a first position and a second position.

12. The projectile launcher of claim 10, wherein the linkage comprises a frame defining a camming slot corresponding to the appendage; and the appendage includes a pin slidably disposed in the camming slot to translate linear movement of the linkage to pivoting movement of the appendage.

13. The projectile launcher of claim 10, and further comprising a spring connected to the trigger for biasing the trigger and the appendage toward their respective first positions.

14. The projectile launcher of claim 1, wherein the housing includes a clip for storing a projectile.

15. A projectile launcher comprising:

a housing;

a projectile launch tube slidably joined to the housing for movement between a first position and a second position, the launch tube including a first portion for removably mounting a projectile and a hollow second portion in fluid communication with the first portion;

a launch tube spring biasing the launch tube toward the first position;

a piston slidably disposed in the housing for movement from an uncocked position to a cocked position in response to the launch tube moving from the first position to the second position, and from the cocked position to the uncocked position to compress fluid in the second portion of the launch tube;

a piston spring biasing the piston toward the uncocked position;

a sear slidably joined to the housing for releasably retaining the piston in the cocked position;

an appendage pivotally engaged to the housing; and a trigger pivotally joined to the housing for sliding the sear to release the piston from the cocked position and for pivoting the appendage.

16. The projectile launcher of claim 15, wherein the hollow second portion of the launch tube is adapted to slidably receive the piston.

17. The projectile launcher of claim 15, and further comprising:

a plurality of appendages pivotally engaged to the housing; and a linkage joined to the trigger and to the appendages for pivoting the appendages between a first position and a second position when the trigger pivots between a first position and a second position.

18. The projectile launcher of claim 17, wherein the linkage comprises a frame defining a camming slot corresponding to each of the appendages; and each appendage includes a pin slidably disposed in a corresponding camming slot to translate linear movement of the linkage to pivoting movement of the appendages.

19. The projectile launcher of claim 17, and further comprising a spring connected to the trigger for biasing the trigger and the appendages toward their respective first positions.

20. The projectile launcher of claim 15, wherein the launch tube further comprises a divider disposed between the first portion and the hollow second portion, the divider defining an aperture in fluid communication with the first and second portions of the launch tube.

21. The projectile launcher of claim 20, wherein the divider engages the piston as the launch tube is moved from the first position to the second position for cocking the piston.

22. The projectile launcher of claim 15, and further comprising:

a sear spring for biasing the sear toward a first position; and a cam pivotally connected to the trigger for movement from a first position to a second position to slide the sear toward a second position and release the piston from the cocked position.

23. The projectile launcher of claim 22, wherein the trigger includes a slot, and wherein the cam includes a pin slidably disposed in the trigger slot to translate pivoting movement of the trigger to linear movement of the cam.

24. The projectile launcher of claim 15, wherein the appendage comprises means for sliding the sear to release the piston from the cocked position when the appendage moves from a first position to a second position.

25. The projectile launcher of claim 15, wherein the housing includes a clip for storing a projectile.

* * * * *